United States Patent [19]

Penny et al.

[11] 3,978,912

[45] Sept. 7, 1976

[54] REGENERATIVE HEAT EXCHANGER

[75] Inventors: Robert Noel Penny, Solihull; Peter James Waters, Birmingham, both of England

[73] Assignee: Caterpillar Tractor Co., Peoria, Ill.

[22] Filed: Sept. 17, 1974

[21] Appl. No.: 506,832

[52] U.S. Cl. ..... 165/4; 60/39.51 R

[51] Int. Cl.[2] ..... F28D 17/00

[58] Field of Search ..... 165/4, 10; 60/39.51

[56] References Cited

UNITED STATES PATENTS

| | | | |
|---|---|---|---|
| 1,538,686 | 5/1925 | Chamberlain | 165/4 |
| 2,862,434 | 12/1958 | Edwards | 165/4 X |
| 3,225,819 | 12/1965 | Stevens | 165/4 X |

FOREIGN PATENTS OR APPLICATIONS

| | | | |
|---|---|---|---|
| 275,231 | 4/1928 | United Kingdom | 165/4 |
| 738,811 | 10/1955 | United Kingdom | 165/4 |

*Primary Examiner*—Albert W. Davis, Jr.
*Attorney, Agent, or Firm*—Gifford, Chandler & Sheridan

[57] ABSTRACT

A regenerative heat exchanger particularly for a gas turbine engine in which there is a stationary heat-storing matrix in each of the flow-paths for the fluids between which heat exchange is to take place and at least one valve member defining a common wall between the flow-paths and movable between two extreme operable positions, in one of which one of the fluids passes through one of the flow-paths and the matrix associated therewith and the other of the fluids passes through the other of the flow-paths and the matrix associated therewith and in the other extreme position the fluid flow through the respective flow-paths is interchanged.

2 Claims, 8 Drawing Figures

REGENERATIVE HEAT EXCHANGER

BACKGROUND OF THE INVENTION

The invention relates to a regenerative heat exchanger and is particularly concerned with such a heat exchanger for transferring heat from turbine exhaust gases to compressed air being supplied to a combustion chamber of a gas turbine engine.

Stationary regenerative heat exchangers have been used in industrial heat engine plants and have comprised pairs of heat storage chambers through which the alternate flow of fluids between which heat exchange is to be effected has been controlled by separate valves associated with each heat storage chamber. An example of such a heat exchanger is the well-known Cowper stove used in iron and steel works. The valves employed in such heat exchangers are usually manually-operable and therefore the known regenerative heat exchangers would not be suitable for use with small gas turbine engines of the kind proposed to be used in automotive gas turbine engines, which normally have a rotary regenerative heat exchanger in which heat exchange is effected automatically.

SUMMARY OF THE INVENTION

According to the invention, a regenerative heat exchanger comprises ducting defining a pair of flow-paths for the separate passage therethrough of fluids between heat exchange is to be effected, a stationary heat-storing matrix in each of the flow-paths, at least one valve member defining a common wall between the flow-paths and movable between two extreme operable positions, in one of which extreme positions one of the fluids passes through one of the flow-paths and the matrix associated therewith and the other of the fluids passes through the other of the flow-paths and the matrix associated therewith and in the other extreme position the fluid flow through the respective flow-paths is interchanged, and means for moving the valve member between its extreme positions, whereby one or other of the matrices will be heated by the hotter fluid while the remaining matrix is imparting heat to the cooler fluid.

Conveniently, the valve member is a pivotally-mounted plate, that is it is a valve member of the butterfly type.

In one preferred construction, the heat exchanger includes two valve members each comprising a pivotally mounted plate of the butterfly type, mounted one in each of the flow-paths. Where one of the flow-paths is to convey compressed air from a compressor of a gas turbine engine to the combustion chamber thereof and the other of the flow-paths is to convey, in counterflow, exhaust gases from a turbine of the engine to exhaust, it is desirable that the valve member separating compressed air supplied to the combustion chamber from the turbine exhaust gases shall be changed-over to its other extreme position before the other valve member is changed-over, so that leakage flow of compressed air towards the turbine will be arrested by the flow of hot gases from the turbine, the other valve member then being changed-over, so that when both valve members have been fully changed-over, the flow of fluids through their respective flow-paths will have been interchanged without substantial loss of compressed air to atmosphere.

In another preferred construction, each heat-storing matrix is a plate of arcuate cross-sectional shape arranged diametrically opposite each other and co-axial with the axis of rotation of the valve member, the valve member comprising a first pivotally mounted plate having radially-outer sealing edges engaging the concave faces of the respective matrices and a second pivotally mounted plate of U-shape embracing the first plate and the matrices and having a pair of radially-inner sealing edges on the limbs of the U-shaped plate and engaging the convex faces of the respective matrices, the first and second plates being mounted co-axially on a common shaft by which they are turned in unison.

BRIEF DESCRIPTION OF THE DRAWINGS

By way of example two embodiments of a regenerative heat exchange in accordance with the invention are now described with reference to the accompanying drawings, in which.

DESCRIPTION OF THE PREFERRED EMBODIMENTS

Figure 1:
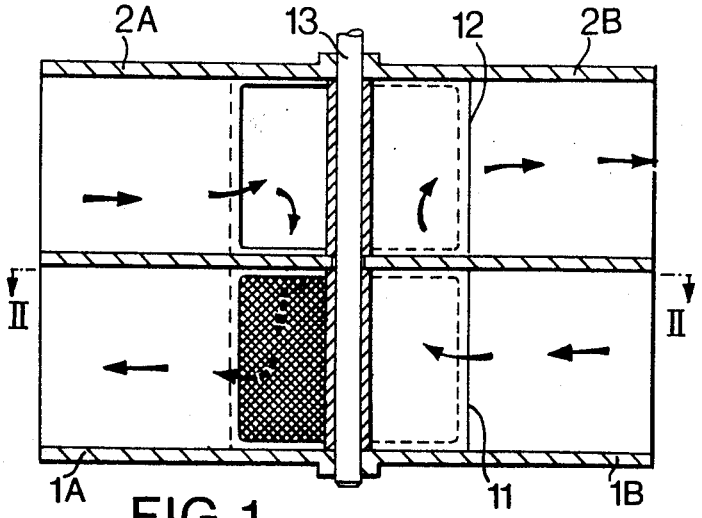
FIG. 1 is a vertical longitudinal section through the first heat exchanger.

Referring firstly to FIGS. 1 to 4, the first heat exchanger comprises a pair of ducts each formed from two portions 1A, 1B or 2A, 2B respectively, positioned end-to-end as illustrated. The ducts 1A, 1B and 2A, 2B are mounted one on top of the other, or side-by-side, and each contains a pair of apertures 3, 4 and 5, 6 respectively in opposite side walls of the ducts. The aperture 3 of the duct 1A, 1B is connected to the aperture 5 of the other duct 2A, 2B by means of a transfer duct 7 and similarly the apertures 4 and 6 are connected by a transfer duct 8. The apertures 3 and 4 each contain or communicate directly with a heat-storing matrix in the form of a panel 9 and 10 respectively of a heat-storing material, for example a porous panel or ceramic or ceramic-like material, e.g., silicon nitride. Each duct 1A, 1B and 2A, 2B contains a pivotally-mounted butterfly valve member 11, 12 respectively extending obliquely across the duct to seal against diagonally-opposite edges of the apertures 3, 4 and 5, 6 respectively and to separate the duct portion 1A from the duct portion 1B and 2A from the duct portion 2B respectively. The butterfly valve members 11, 12 are mounted for rotation about a common pivotal axis by means of a shaft 13, although as explained later they may be individually pivotable about a common axis.

The heat exchanger is connected in the flow circuit of the gas turbine engine in such a way that the duct portion 2A receives compressed air from the compressor of the engine and the duct portion 1A discharges compressed air to the combustion chamber of the engine. The duct portion 1B receives exhaust gases from a power turbine of the engine and the duct portion 2B discharges the exhaust gases to atmosphere.

Figure 2:
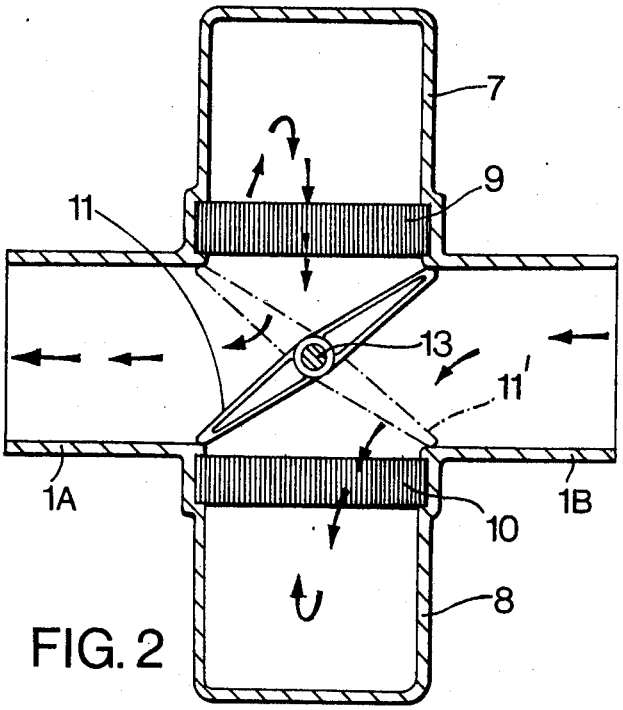
FIG. 2 is a horizontal longitudinal section on the line II—II, in FIG. 1.
Figure 3:
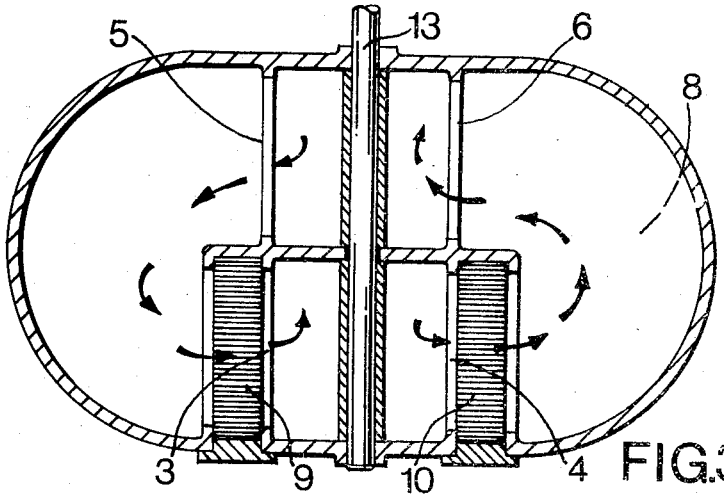
FIG. 3 is a vertical section on the line III—III in FIG. 2.
Figure 4:
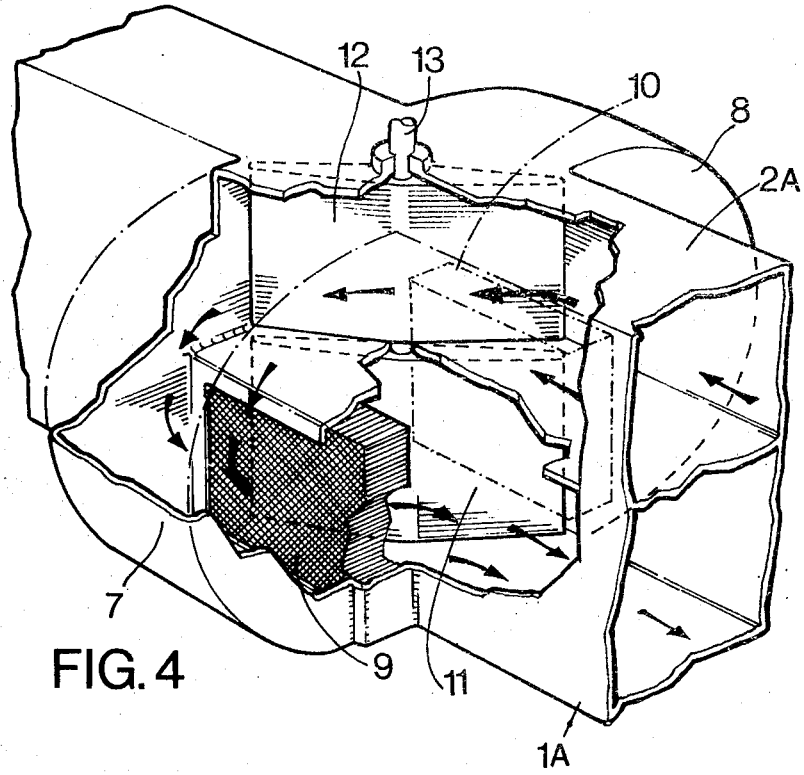
FIG. 4 is a perspective view of the first heat exchanger.
Figure 5:
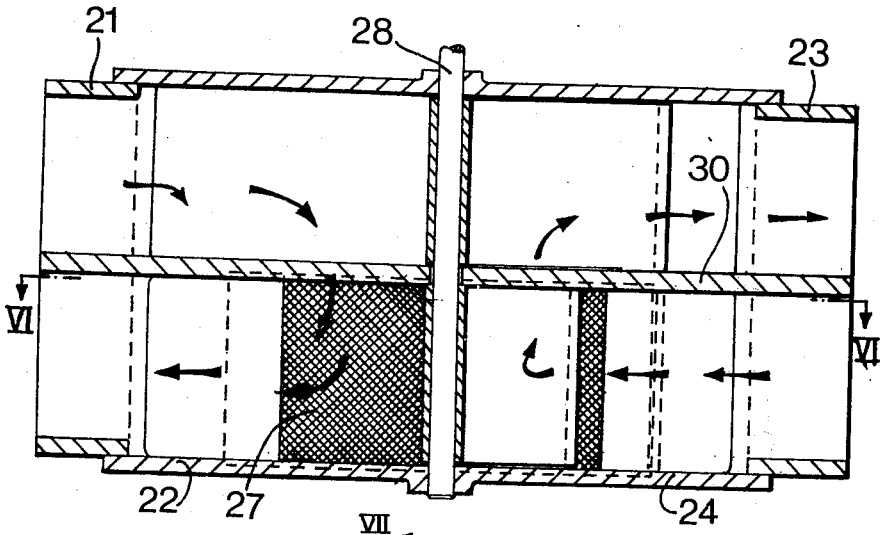
FIG. 5 is a vertical section through the second heat exchanger.
Figure 6:
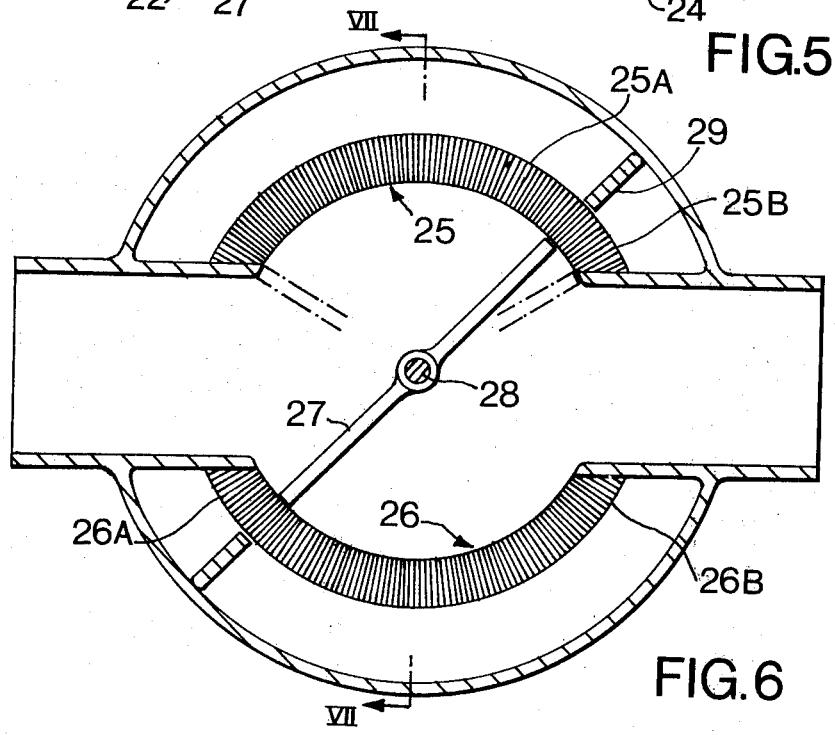
FIG. 6 is a section on the line VI—VI in FIG. 5.
Figure 7:
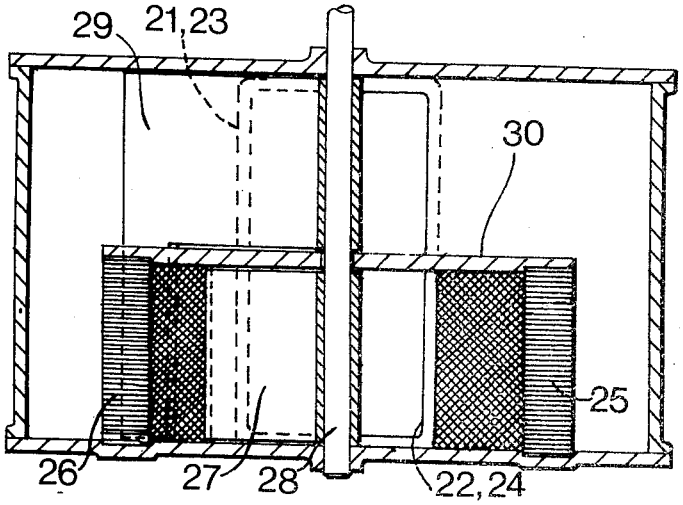
FIG. 7 is a section on the line VII—VII in FIG. 6.
Figure 8:
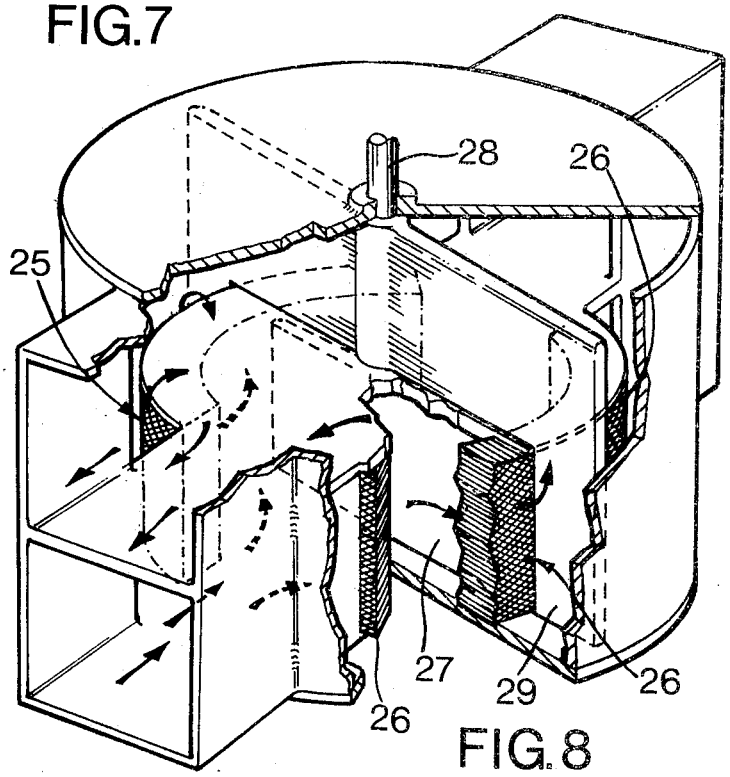
FIG. 8 is a perspective view of the second heat exchanger.

When the valve members 11, 12 are both in the position illustrated in full lines in FIG. 2, compressed air flows through the duct portion 2A through the aperture 5 into the transfer chamber 7 from which it flows through the heat exchanger matrix 9 located in the aperture 3 into the duct portion 1A. Simultaneously exhaust gases from the power turbine entering through the duct portion 1B flow through the heat exchanger matrix 10 located in the aperture 4 into the transfer passage 8 from which they flow through the aperture 6 into the duct portion 2B to atmosphere. The exhaust gases impart heat to the heat exchanger matrix 10 while the heat exchanger matrix 9 which has been previously heated by exhaust gases gives up its heat to the compressed air. After a predetermined time, the spindle 13 is turned to swing both valve members to their opposite diagonal positions, as shown in chain lines and by reference 11' in FIG. 2, when compressed air entering through the duct portion 2A passes through aperture 6 into the transfer passage 8 and through the heat exchanger matrix 10 into the duct portion 1A and simultaneously hot exhaust gases from the power turbine enter the duct portion 1B, flow through the heat exchanger matrix 9 into the transfer passage 7 and from there through the aperture 5 into the duct portion 2B. In this way the compressed air is heated by the heat exchanger matrix 10 and the heat exchanger matrix 9 is heated by the hot exhaust gases from the power turbine.

To prevent leakage of compressed air direct to exhaust when the valve members 11, 12 are changed-over, it is desirable to change-over the valve member 11 prior to the changing-over of the valve member 12. This would necessitate having two separate spindles for the valve members instead of the common spindle 13. At the end of each half cycle of operations, the changing-over of the valve member 11 is commenced before the valve member 12 is moved. This places compressed air into direct contact with exhaust gases from the power turbine. As the pressure differential between the compressed air after passing through a heat exchanger matrix and the exhaust gases from the turbine is less than the pressure differential between the compressed air pressure upstream of a heat exchanger matrix and atmospheric pressure, the compressed air and the turbine exhaust gases would tend to meet in the appropriate transfer passage. At that instant, the valve member 12 is rapidly changed-over and then the changing-over of the valve member 11 is completed. In this way there will be no direct contact between compressor delivery pressure and atmosphere and therefore substantially no loss of compressed air. Where the valve members are operable independently, the valve member 12 can at any time quickly be placed in an intermediate position so that there is direct contact between the portions 2A and 2B of the upper duct so that compressed air can escape past the valve member 12 to atmosphere, thereby causing a rapid shut-down of the engine. Thus the provision of independently-operable valve members in the heat exchanger in accordance with the present invention provides a safety control by which rapid shut-down of the engine can be effected.

As the heat exchanger matrices 9 and 10 are panels which fit into the apertures 3 and 4 respectively, they can be quickly replaced by fresh matrices. The sealing edges of the valve members 11, 12 contact members defining edges of the appropriate apertures 3, 4 or 5, 6 and thus a metal-to-metal seal can be effected, that is the valve members need not seal against the heat exchanger matrices as in a rotary regenerative heat exchanger. Therefore the sealing may be made more efficient and easier to achieve, thereby leading to longer life of the matrices as there is no wear of the matrix material. Another advantage is that the changing-over time can be made infinitely variable so that optimum heat recovery can be obtained under all engine conditions. The whole area of each matrix is exposed except during the changing-over operation of the valves. Although the matrix elements have been shown as flat panels, they could be of any other convenient form.

Turning now to FIGS. 5 to 8, the second heat exchanger comprises a housing defining ducts 21, 22, 23, 24. The ends of the ducts 22 and 24 adjacent the ducts 21 and 23 each contain a heat exchanger matrix 25, 26 in the form of a panel of arcuate shape. A butterfly valve member 27 pivotable by a shaft 28 is mounted to swing co-axially within the matrices 25 and 26 to seal at its end edges against the inner faces of the matrices. Thus the valve member 27 always separates the duct 21 from the duct 23. Compressed air from a compressor of the gas turbine engine enters duct 21 and passes through a portion 25A and a portion 26A of the matrices 25 and 26 respectively and through corresponding portions of the ducts 22 and 24. Similarly exhaust gases from the remaining portions of the ducts 22 and 24 pass through matrix portions 25B and 26B and are discharged through duct 23 to atmosphere. The division of the matrices 25 and 26 into portions 25A and 25B and 26A and 26B respectively is effected by the end edges of the member 27. In order to separate each of the ducts 22 and 24 into corresponding portions, there must be a valve member engaging the convex outside surfaces of the matrices 25 and 26. This is in the form of a U-shaped butterfly valve member 29 embracing the matrices 25 and 26, the valve member 27 and a partition 30 separating the valve member 29 from the valve member 27. The two valve members 27 and 29 are both mounted on the shaft 28 and are swung thereby in unison.

The arrangement shown in FIGS. 5 to 8 while similar in principle to that shown in FIGS. 1 to 4 differs in that there is only one valve member 27, if the outer valve member 29 is regarded as being a part of the valve member 27. The arrangement also has the advantage that there is constant flow area through the effective matrix portions, that is the sum of portions 25A and 26B and the sum of portions 25B and 26B are each equal to the area of the whole matrix 25 or 26.

In either embodiment, the valve member can be made hollow and be internally cooled, for example by compressed air bled from the compressor delivery. The cooling air may be leaked across the sealing edges of the valve members so as to equalise pressure across them to aid their opening and also to effect cooling of those edges. The valve members may be shaped to guide fluid flow into or out of the heat exchanger matrices.

The valve members or the operating shaft or shafts therefor may be provided with over-centre or toggle devices or spring mechanisms so that a snap action operation on change-over will be effected.

Another feature of the heat exchangers according to this invention are that the cross-sectional areas of the ducts 1A, 1B and 2A, 2B or 21 to 24 may be small compared with the cross-sectional flow area of the matrices 9, 10 or 25, 26.

What we claim as our invention and desire to secure by Letters Patent of the United States is:

1. A regenerative heat exchanger comprising a pair of ducts defining flow-paths for the separate passage therethrough of fluid between which heat exchange is to be effected, an aperture provided in opposite sides of each duct, a pair of transfer ducts each arranged substantially transversely of said pair of ducts to provide communication between one said aperture in one of said pair of ducts and a corresponding aperture in the other of said pair of ducts, a stationary heat-storing matrix in the form of a substantially flat panel contained in each aperture in one of said pair of ducts, a pair of valve members each in the form of a pivotally mounted plate arranged in one of said pair of ducts and defining a common wall between the flow-paths in the respective duct, and means to effect movement of the valve members between two extreme operable positions, in each of which each said valve member extends obliquely across the respective duct of said pair of ducts, in one of which extreme positions one of the fluids passes through one of said transfer ducts and said matrix associated therewith and the other of the fluids passes through said other transfer duct and said matrix associated therewith and in the other extreme position the fluid flow through the respective transfer ducts and the associated matrices is interchanged, whereby each of said matrices will be heated in succession by the hotter fluid while the other said matrix is imparting heat to the cooler fluid, each said valve member engaging in each extreme operable position an edge of each aperture in the respective duct.

2. A heat exchanger as claimed in claim 1 in which the means to effect movement of the valve members is a common shaft interconnecting said valve members, whereby the valve members are moved in unison between their extreme operable positions.

* * * * *

UNITED STATES PATENT AND TRADEMARK OFFICE

CERTIFICATE OF CORRECTION

PATENT NO. : 3,978,912

DATED : September 7, 1976

INVENTOR(S) : Robert N. Penny, et al

It is certified that error appears in the above-identified patent and that said Letters Patent are hereby corrected as shown below:

Col. 4, line 52, delete "26B" and insert --26A--

Signed and Sealed this

Twenty-first Day of December 1976

[SEAL]

*Attest:*

RUTH C. MASON
*Attesting Officer*

C. MARSHALL DANN
*Commissioner of Patents and Trademarks*